US005146232A

United States Patent [19]

Nishikawa et al.

[11] Patent Number: 5,146,232

[45] Date of Patent: Sep. 8, 1992

[54] LOW PROFILE ANTENNA FOR LAND MOBILE COMMUNICATIONS

[75] Inventors: Kunitoshi Nishikawa, Nagoya; Kazuo Sato, Aichi, both of Japan

[73] Assignee: Kabushiki Kaisha Toyota Chuo Kenkyusho, Aichi, Japan

[21] Appl. No.: 662,638

[22] Filed: Feb. 28, 1991

[30] Foreign Application Priority Data

Mar. 1, 1990 [JP] Japan ..... 2-51500

[51] Int. Cl.[5] ..... H01Q 1/32

[52] U.S. Cl. ..... 343/713; 343/829; 343/830

[58] Field of Search ..... 343/713, 700 MS File, 343/752, 828, 829, 830, 702

[56] References Cited

U.S. PATENT DOCUMENTS

| | | | |
|---|---|---|---|
| 3,967,276 | 6/1976 | Goubau | 343/752 |
| 4,201,989 | 5/1980 | Czerwinski | 343/715 |
| 4,835,541 | 5/1989 | Johnson et al. | 343/713 |
| 4,887,090 | 12/1989 | Shibano et al. | 343/713 |
| 4,907,006 | 3/1990 | Nishikawa et al. | 343/713 |

FOREIGN PATENT DOCUMENTS

| | | |
|---|---|---|
| 0332139 | 9/1989 | European Pat. Off. . |
| 879850 | 6/1953 | Fed. Rep. of Germany . |
| 926173 | 5/1963 | United Kingdom . |

OTHER PUBLICATIONS

Review of the Electrical Communication Laboratories, vol. 30, No. 2, Mar. 1982, pp. 359-370, Tokyo, JP; H. Mishima et al, "Antenna and Duplexer for new Mobile Radio Unit".

Patent Abstracts of Japan, vol. 1, No. 162 (E-077), Dec. 21, 1977 & JP-A-52 108 755 (Matsushita Denki Sangyo K.K.), Sep. 12, 1977.

*Primary Examiner*—Michael C. Wimer
*Assistant Examiner*—Hoanganh Le
*Attorney, Agent, or Firm*—Oblon, Spivak, McClelland, Maier & Neustadt

[57] ABSTRACT

An antenna mounted on a mobile. In a first structure, a radiating element is composed of a ground plate, a vertical conductor plate and a parallel conductor plate placed on the ground plate with a predetermined space therebetween in such a manner as to have a T-shaped section and placed on the ground plate with a narrow space therebetween, and posts for connecting the edges of the parallel plate to the ground plate. Power is fed to the lower edge of the vertical conductor plate, thereby enabling a plurality of current paths to be formed in the radiating element and, hence, resonance in a wide frequency band. In a second structure, a radiating element has a conductor plate for impedance compensation in the vicinity of the feeding point of a conductor which is bent in the form of substantially a box, thereby enabling the reduction of the entire size and sufficiently increasing the length of the radiating element. In a third structure, a radiating element having the first structure and a radiating element having the second structure are adopted for effecting diversity reception.

18 Claims, 12 Drawing Sheets

LOW PROFILE ANTENNA FOR LAND MOBILE COMMUNICATIONS

BACKGROUND OF THE INVENTION

1. Field of the Invention

The present invention relates to a mobile antenna mounted on a mobile such as an automobile and, in particular, to a mobile antenna having a small size and a small height in a mounted state and suitable for diversity reception.

2. Description of the Related Art

With the recent rapid progress of electronic communication technique, communication apparatuses having a higher function and a smaller size have been developed and utilized for various kinds of mobile communication apparatuses. Especially, mobile telephones have already become widespread due to their convenience.

In such a mobile communication apparatus, an antenna which is mounted on a mobile has a very important role. That is, in a mobile communication apparatus such as a mobile telephone, radio waves must be transmitted and received between a mobile which changes the position thereof every moment and a fixed base station, and communication is impossible without sufficient transmission and reception on the side of the antenna mounted on the mobile.

A rod-like antenna such as a dipole antenna has conventionally been used widely as a mobile antenna. This is because a dipole antenna is considered to be suitable for transmitting and receiving a vertically polarized wave which is used for a mobile communication apparatus such as a mobile telephone.

A dipole antenna, however, must have a length of about half the wavelength of the radio wave which is used for communication, for example, about 16.7 cm in the case of a radio wave of 900 MHz which is used for a mobile telephone. If such a long antenna protruding from a vehicle body is mounted on an automobile, it may be broken and there is also a problem in aesthetic appearance.

To solve these problems, inverted F antenna such as that shown in FIG. 12, loop antenna such as that shown in FIG. 13, and table antenna such as that shown in FIG. 14, etc. have conventionally been proposed as an antenna having a small height in a mounted state.

The inverted F antenna shown in FIG. 12 has a structure in which one end of a radiating element 12 disposed on a ground plane 10 is bent so as to be connected to the ground plate 10.

The length $L_2$ of the radiating element 12 is about $\frac{1}{4}$ of the wavelength $\lambda g$ of the propagated wave. The inner conductor 14*a* of a coaxial feeder 14 is connected to a point which is $d_l$ distant from the bent portion of the radiating element 12 for the purpose of the impedance matching between the coaxial feeder 14 consisting of the inner conductor 14*a* and an outer conductor 14*b* and the radiating element 12. By adjusting the distance $d_l$, it is possible to adjust the input impedance at the feeding point of the antenna in conformity with the impedance (usually about 50 Ω) of the coaxial feeder 14.

In this way, it is possible to transmit and receive a predetermined radio wave from and by the radiating element 12 by the current supplied from the coaxial feeder 14.

The loop antenna shown in FIG. 13 has a structure in which the coaxial feeder 14 is protruded from the ground plane 10 with the inner conductor 14*a* thereof formed into an arcuate loop having a length of Lp with the other end of the loop in contact with the ground plane 10. The height of the loop 12 from the ground plane 10 is set at Hp.

According to this structure, the antenna resonates at the frequency at which the length Lp of the loop 12 is about $\frac{1}{2}$ of the wavelength of the radio wave transmitted and received. Transmission and reception are therefore possible at this frequency.

FIG. 14 shows a table antenna. This table antenna has a structure in which a circular radiating element (table) 12 having a diameter of Dt is supported by four conductor posts 16 having a height of ht and disposed on the ground plane 10, and the inner conductor 14*a* of the coaxial feeder 14 is connected to the central part of the radiating element 12.

In this table antenna, feeding is conducted through the inner conductor 14*a* of the coaxial feeder 14 connected to the central part of the table 12 which is horizontally placed.

Current $I_1$ thus radially flows from the feeding point to the four posts 16 and the antenna resonates at a frequency at which the wavelength of the radio wave is equal to about twice the path length of the current.

In this table antenna, a relative band width is as broad as about 10%, and in this respect it is considered to be suitable for a mobile communication antenna.

Mobile communication is frequently influenced by the reflection and scattering of the radio wave due to buildings and the like while the mobile is travelling in an urban district. A mobile communication apparatus mainly conducts communication in an environment of multipath propagation caused by the scattering or reflection of the radio wave, so that it is impossible to avoid the deterioration of the communication quality due to the generation of fading.

One of the methods for lightening the influence of the fading phenomenon is diversity reception. Diversity reception is a method of improving the communication quality by arranging a plurality of (usually two) antennas with a predetermined space therebetween and automatically switching the current antenna over to the antenna which has received a signal at a higher level or compounding the signals received by the respective antennas.

In the antennas used for diversity reception, it is important that the correlation between the received signals is small. For this purpose, it is necessary to arrange the antennas such that the mutual coupling between the two antennas is as small as possible.

In this case, it is possible to make the coupling level sufficiently low by broadening the space between the two antennas. It is, however, impossible to arrange the two antennas with a large space therebetween due to the limited size of a mobile. As a countermeasure, two dipole antennas with one placed on top of the other on a vertical line is conventionally used for achieving the diversity reception in a mobile. This structure enables antennas to be mounted on a small mobile.

As described above, antennas having a small size and a small height in a mounted state are conventionally proposed. These antennas, however, the following problems.

In an inverted F antenna, the direction in which the radiation of the radio wave from the radiating element 12 is the maximum has such a high elevation that sufficient transmission and reception from and by the base station on the ground is impossible. In addition, since the direction of flow of the current in the radiating element 12 is limitative, it is impossible to obtain an antenna which has an omni-directional pattern in a horizontal plane. The transmission and reception sensitivity therefore depends upon the direction in which the base station is located. Furthermore, the relative band width is disadvantageously narrow.

A loop antenna, which has a very simple structure, is considered to be suitable as a mobile antenna. However, if the loop antenna has a small height in a mounted state, namely, if the height Hp is smaller than the width Wp, the capacitance between the radiating element line and the ground plane becomes large, the impedance becomes capacitive and the radiation resistance becomes small. (In the extreme case in which Hp is 0, the radiation resistance becomes 0). That is, if a loop antenna has a small height in a mounted structure, it is difficult to obtain matching between the radiating element 12 and the coaxial feeder 14 and the band width becomes disadvantageously narrow.

The resonance frequency of a table antenna is a frequency at which the current path Lt has a length equivalent to about ½ wavelength, as described above.

$$Lt=2\times ht+Dt$$

wherein ht represents the height of a table and Dt a diameter of the table.

Therefore, if the height ht is reduced, it is necessary that the diameter Dt of the table must be about ½ wavelength (for example, if the radio wave has a frequency of 900 MHz, the diameter is about 16.7 cm), and the antenna cannot be said to have a small size.

Especially, if two antennas of this type are used for diversity reception, the size of the antenna system becomes considerably large and the coupling level of the two antennas becomes very high.

In order to achieve diversity reception in a mobile antenna, it is necessary to make the coupling level as low as possible. Mere arrangement of the conventional small-sized antennas described above, however, disadvantageously increases the coupling level. In the case of vertically placing one antenna on top of another, the height of the antenna system becomes very large.

SUMMARY OF THE INVENTION

Accordingly, it is an object of the present invention to eliminate the above-described problems in the related art and to provide a mobile antenna which has a small size, a small height in a mounted state and adequate transmission and reception characteristics and which is capable of effective transmission and reception by combining two antenna elements having different structures.

To achieve this aim, in a first aspect of the present invention, there is provided a mobile antenna having a ground plate and a radiating element placed on the ground plate, the radiating element comprising: a vertical feeding plate disposed on the ground plate in such a manner that the lower edge thereof is located above the ground plate with a narrow space therebetween and power is fed to the central part of the lower end thereof; a parallel plate connected to the upper edge of the vertical feeding plate; and a pair of conductors with one end of each connected to the central part of the parallel plate edge which is parallel to the plane of the vertical feeding plate and the other end thereof connected to the ground plate.

The mobile antenna provided in the first aspect of the present invention is composed of a ground plate and a T-shaped plate conductor and two wire conductors (posts) placed on the ground plate.

If a pair of opposing posts are removed from the four posts in the antenna shown in FIG. 14 and the shape of the table is converted into a rectangle as shown in FIG. 15, not only does the current $I_1$ flow from the feeding point directly to the posts 16 but also current $I_2$ flows from the feeding point to the posts 16 along an edge of the table 12.

It is considered that since the path of the current $I_2$ which flows along an edge of the table 12 is longer than the radial path in the conventional antenna shown in FIG. 14, the resonance frequency of this antenna will be lower than that of the conventional one. That is to say, in order to obtain the same resonance frequency, it is possible to reduce the size of the antenna shown in FIG. 15 than the conventional one shown in FIG. 14.

The mobile antenna in the first aspect of the present invention is provided on the basis of this finding and adopts two wire conductors (posts) as the radiating element. It is thus possible to provide a small-sized mobile antenna.

The shortest path of the current which flows from the feeding point at the center of the parallel plate (table) to the post has a length which is equivalent to the distance between the feeding point and the post 16, and the longest path has a length which is equivalent to the distance from the feeding point to the post 16 through the center of the side of the table which is parallel to the line connecting the two posts 16 and a corner of the table 12 as indicated by a U-shaped arrow in FIG. 2. In this way, since this antenna has various current paths, it can have a resonance frequency in a wide band width.

In addition, in this antenna, power is fed not to one point of the table by a feed probe but linearly to the table by using a vertical feeding plate. It is therefore possible to reduce the value Q (value representing the strength of the resonance) of the antenna and to lower the radiation impedance of the radiating element as viewed from the feeding point on the ground plate. Matching with the coaxial feeder or the like for feeding is therefore facilitated.

If an antenna has a structure in which power is fed to one point at the center of a rectangular table and both ends of the table are grounded by two posts, the radiation impedance of the antenna becomes too high for matching with a coaxial feeder in comparison with the impedance (about 50 Ω) of the coaxial feeder for feeding. In contrast, the antenna provided in the first aspect of the present invention adopts a vertical plate conductor for feeding and it is possible to adjust the value Q of the antenna by adjusting the lengths of the lower edge and the upper edge of the vertical feeding plate, thereby enabling the adjustment of the impedance in a wide frequency band.

In this way, the mobile antenna in the first aspect of the present invention is advantageous in that in spite of its small size and small height in a mounted state, the resonance frequency band is wide and the impedance matching with the coaxial feeder is facilitated.

In a second aspect of the present invention, there is provided a mobile antenna having a ground plate and a radiating element placed on the ground plate, the radiating element comprising: a first vertical member disposed on the ground plate in such a manner that one edge thereof is placed above the ground plate with a narrow space therebetween and power is fed to the central part of the lower end thereof; a first parallel member connected to the upper end of the first vertical member and extending in parallel to the ground plate; a second vertical member connected to the other end of the first parallel member vertically to the ground plate; a second parallel member which is connected to the other end of the second vertical member and disposed at a position between the first parallel member and the ground plate in parallel thereto and which is shorter than the first parallel member; a conductor for connecting the other end of the second parallel member and the ground plate; and a plate conductor element for impedance compensation which is connected to the vicinity of the feeding point of the first vertical member.

The mobile antenna provided in the second aspect of the present invention is composed of a ground plate, a radiating element which is bent in the shape of substantially a box and disposed on the ground plate and a plate conductor element for impedance compensation attached to the vicinity of the feeding point of the radiating element.

Therefore, the antenna resonates when the length of the radiating element bent in the shape of a loop (the length from the connecting point for the coaxial feeder to the connecting point for the ground plate) is about ½ wavelength. It is thus possible to make the length of the radiating element adequately large and obtain a low resonance frequency in spite of the small size of the antenna as a whole.

If the antenna has only the radiating element placed on the ground, the impedance of the feeding point becomes inductive, thereby making impedance matching with the coaxial feeder impossible. In the present invention, a plate conductor element for impedance compensation is attached to the vicinity of the feeding point (for example, about 0.01 to 0.05 wavelength above the ground plate). It is therefore possible to add the capacitance caused by the plate conductor element for impedance compensation to the radiating element, thereby cancelling the inductive component of the impedance. In this way, impedance matching between the coaxial feeder and the radiating element is enabled.

In addition, in this antenna, at least a first parallel member of the radiating element which extends in parallel to the ground plate is composed of a plate conductor. The value Q of the antenna is therefore reduced and impedance matching is thereby facilitated by the element for impedance compensation, so that it is possible to broaden the frequency band in which impedance matching is possible.

Since a part of the radiating element is composed of a plate, the resonance frequency is slightly lowered, but there is no problem if the loop length is slightly shortened in correspondence therewith. The antenna provided in the second aspect of the present invention, which enables impedance matching, as described above, exerts no deleterious influence on the transmission and reception characteristic unlike the conventional loop antenna so long as the height of the radiating element is in the range of about 0.01 to 0.1 wavelength.

In a third aspect of the present invention, there is provided a mobile antenna having a ground plate and a plurality of radiating elements placed on the ground plate, the plurality of radiating elements comprising: a first radiating element including a vertical feeding plate disposed on the ground plate in such a manner that lower edge thereof is placed above the ground plate with a narrow space therebetween and power is fed to the central part of the lower end thereof, a parallel plate connected to the upper end of the vertical feeding plate, and a pair of conductors with one end of each connected to the central part of the parallel plate edge which is parallel to the plane of the vertical feeding plate and the other end thereof connected to the ground plate; a second radiating element including a first vertical member disposed on the ground plate in such a manner that the lower edge is placed above the ground plate with a narrow space therebetween and power is fed to the central part of the lower end thereof, a first parallel member connected to the upper end of the first vertical member and extending in parallel to the ground plate; a second vertical member connected to the other end of the first parallel member vertically to the ground plate, a second parallel member which is connected to the other end of the second vertical member and disposed at a position between the first parallel member and the ground plate in parallel thereto and which is shorter than the first parallel member, a conductor for connecting the other end of the second parallel member and the ground plate, and a plate conductor element connected to the vicinity of the feeding point of the first vertical member; the first and the second radiating elements being arranged with a predetermined space therebetween such that the plane in which the pair of vertical conductors (posts) of the first radiating element exist is substantially parallel to the plane in which the first and the second parallel members and the first and the second vertical members of the second radiating element exist.

The antenna provided in the third aspect of the present invention is a composite antenna obtained by placing the radiating element of the antenna provided in the first aspect of the present invention and the radiating element of the antenna provided in the second aspect of the present invention on a common ground plate.

The second radiating element is disposed in the direction approximately parallel to plane in which the two posts of the first radiating element exist. Therefore, the magnetic field which is radiated from the first radiating element is parallel to the loop, which is the second radiating element, and does not intersect the section of the loop.

It is thus possible to sufficiently lower the coupling level of the first and the second antenna elements, thereby enabling good diversity reception.

Since the antenna element constituted by the first radiating element has a sufficiently wide band width including the bandwidths for both transmission and reception, as described above, it is preferable to use the first antenna element both for transmission and for reception by switching from one to the other and to use the second antenna element exclusively for reception.

As described above, according to the mobile antenna provided in the first aspect of the present invention, since both ends of the table of the radiating element are connected to the ground plate by a pair of posts and power is supplied linearly to the central part of the table by the vertical feeding plate, it is possible to provide an omni-directional antenna having a broad band width and capable of impedance matching in spite of its small size and small height in a mounted state.

According to the mobile antenna provided in the second aspect of the present invention, since the radiating element is formed into a bent loop shape, transmission and reception in an adequately wide frequency width is possible in spite of its small size. In addition, since it is possible to add a capacitance by the plate conductor element, it is possible to cancel the inductive component of the antenna, thereby enabling impedance matching.

In this way, according to the mobile antennas provided in the first and the second aspects of the present invention, adequate transmission and reception characteristics are obtained in spite of their small sizes.

According to the mobile antenna provided in the third aspect of the present invention, since it is possible to greatly lower the coupling level of the elements, it is possible to provide a diversity antenna system having adequate characteristics in spite of its small size and further preferred transmission and reception are enabled.

The above and other objects, features and advantages of the present invention will become clear from the following description of preferred embodiments thereof, taken in conjunction with the accompanying drawings.

DESCRIPTION OF THE PREFERRED EMBODIMENT

Embodiments of the present invention will be explained hereinunder with reference to the accompanying drawings.

First Embodiment

Figure 1:
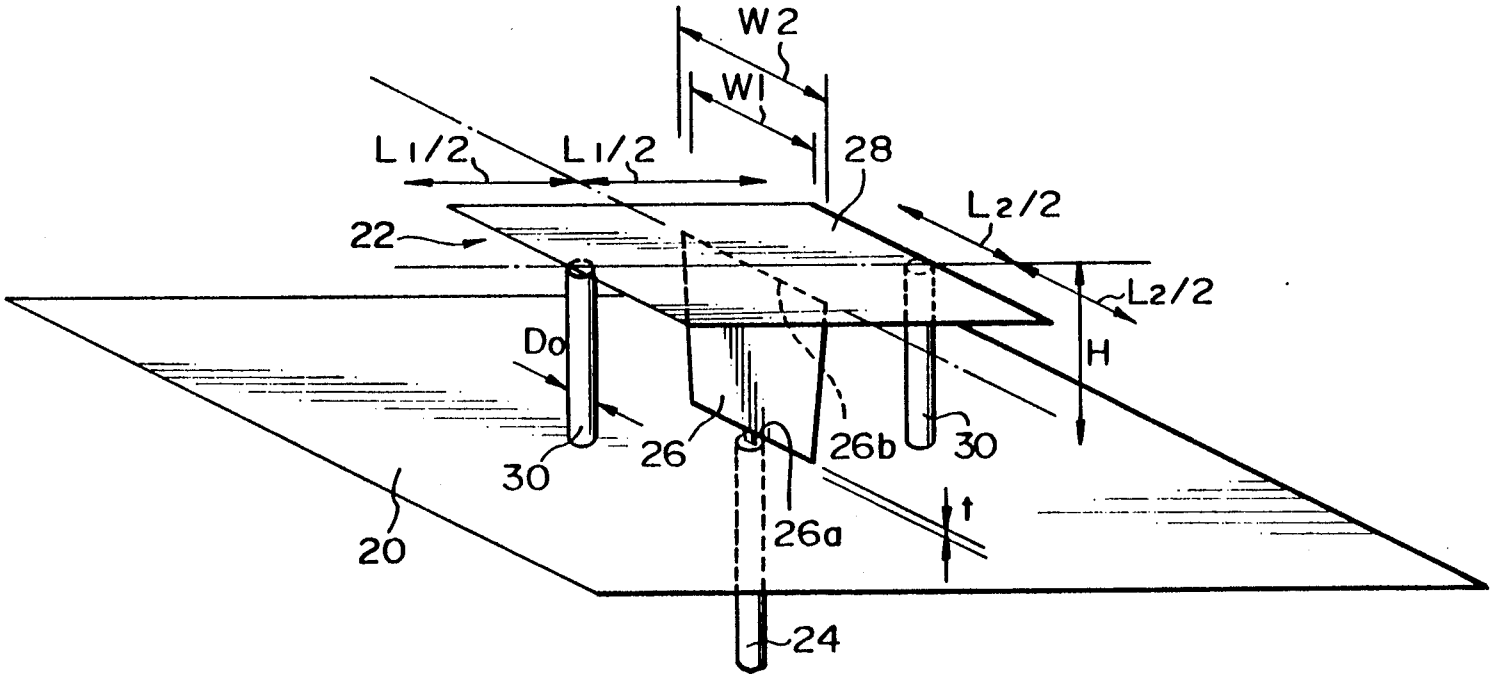
FIG. 1 is an external perspective view of the structure of a first embodiment of a mobile antenna according to the present invention.
Figure 2:
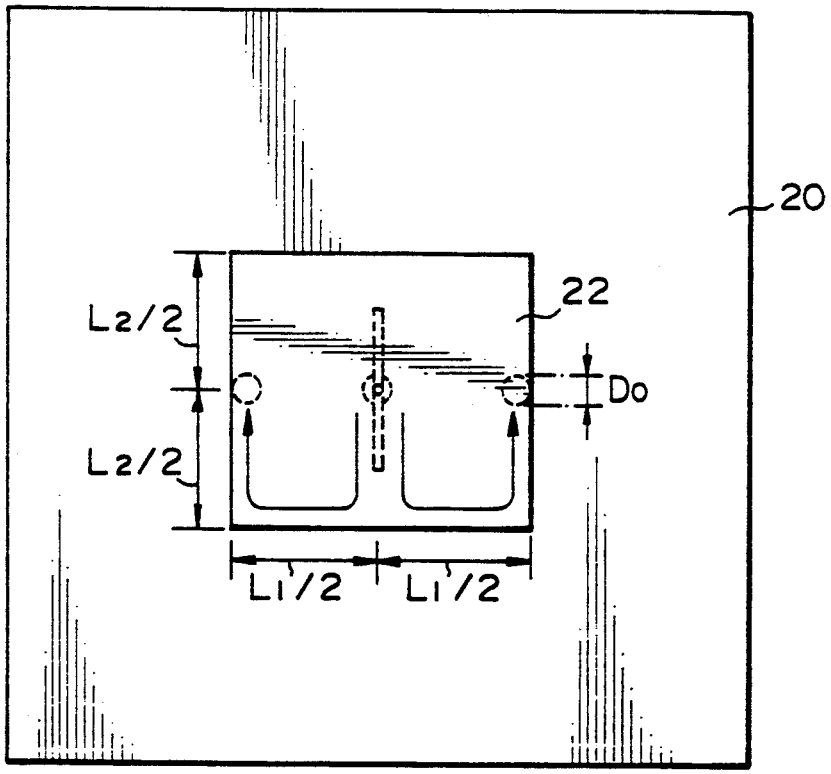
FIG. 2 is a top view of the structure of the first embodiment shown in FIG. 1.
Figure 3:
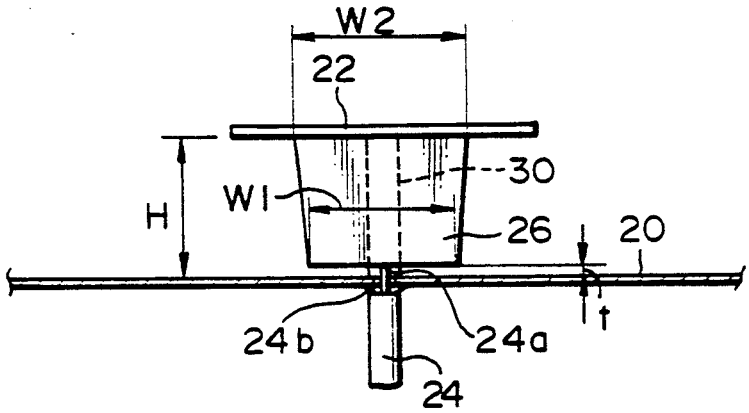
FIGS. 3 and 4 are elevational views of the structure of the first embodiment.
Figure 4:
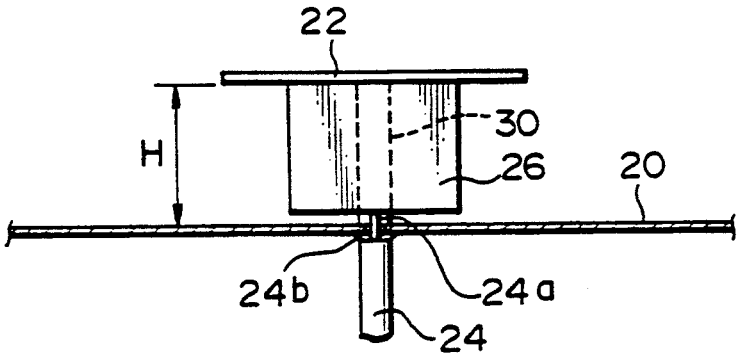

FIG. 1 is an external perspective view of the structure of a first embodiment of a mobile antenna according to the present invention, FIG. 2 is a top view thereof and FIGS. 3 and 4 are elevational views thereof.

A radiating element 22 is placed on a ground plate 20. The inner conductor 24*a* of a coaxial feeder 24 is connected to the radiating element 22 and the outer conductor 24*b* of the coaxial feeder 24 is connected to the ground plate 20.

The radiating element 22 is composed of a vertical feeding plate 26 which is disposed vertically relative to the ground plate 20 with a narrow space therebetween, a rectangular parallel plate (table) 28 which is vertically connected to the vertical feeding plate 26 and disposed in parallel to the ground plate 20, and a pair of wire conductors (posts) 30 for connecting both side ends of the table 28 and the ground plate 20. The post 30 is constituted by a wire or rod-like conductor. It may also be a conductor plate having a narrow width.

The inner conductor 24*a* of the coaxial feeder 24 is connected to the central part of the lower edge 26*a* of the vertical feeding plate 26 and the upper edge 26*b* of the vertical feeding plate 26 is linearly connected to the central part of the table 28.

By connecting the inner conductor 24*a* of the coaxial feeder 24 to the table 28 through the vertical feeding plate 26 in this way, power is fed linearly to the table, thereby enabling the reduction of the value Q (value representing the strength of resonance) of the antenna in comparison with direct feeding to one point. It is therefore possible to match the impedance of the radiating element 22 with the impedance (generally about 50 Ω) of the coaxial feeder 24, thereby enabling preferred feeding.

The vertical feeding plate 26 has a function of cancelling the reactance component of the radiating element 22 by the capacitance component between the vertical feeding plate 26 and the ground plate 20.

The reactance component of the radiating element 22 becomes smaller as the table 28 of the radiating element 22 comes closer to the ground plate 20. Therefore, the length of the lower edge 26*a* of the vertical feeding plate 26 may be made shorter when the table 28 comes closer to the ground plate 20.

In this case, the length $W_1$ of the lower edge 26*a* of the vertical feeding plate 26 may be made shorter than the length $W_2$ of the upper edge 26*b* thereof, as shown in FIG. 3. This is because the length $W_2$ of the connecting point for the table 28 has no direct relationship with the impedance and it is unnecessary to shorten the length thereof.

The antenna having the above structure resonated at a frequency in which the length of the current path represented by the following formula:

$$2H + L_1/2 + L_2$$

wherein H represents the distance between the table 28 and the ground plate 20 and $L_1$, $L_2$ the widths and the length, respectively, of the table 28 is equivalent to about 0.5 wavelength.

This is because the current flows in the directions indicated by the U-shaped arrows as viewed from the feeding point, as shown in the top view in FIG. 2.

In this case, the width and the length $L_1$, $L_2$ of the table 28 are set to be $L_1 \geqq L_2$ and the diameter of the post 30 is set at not more than 0.02 wavelength. If these conditions are not satisfied, the resonance band width becomes narrow and, in an extreme case, matching is impossible.

In this embodiment, the vertical feeding plate 26 may be considered to be an element for impedance matching with the coaxial feeder 24. If the distance H between the table 28 and the ground plate 20 is about 0.15 wavelength, good matching is enabled when the length $W_2$ of the upper edge 26b and the length $W_1$ of the lower edge 26a of the vertical feeding plate 26 are approximately equal to the distance H. It is also possible to adjust the value of the capacitance component by adjusting the gap t between the lower edge 26a of the vertical feeding plate 26 and the ground plate 20.

The dimension of each part of the antenna will now be explained on the assumption that the central frequency for transmission and reception is $f_0$ (wavelength: $\lambda_0$).

Figure 5:
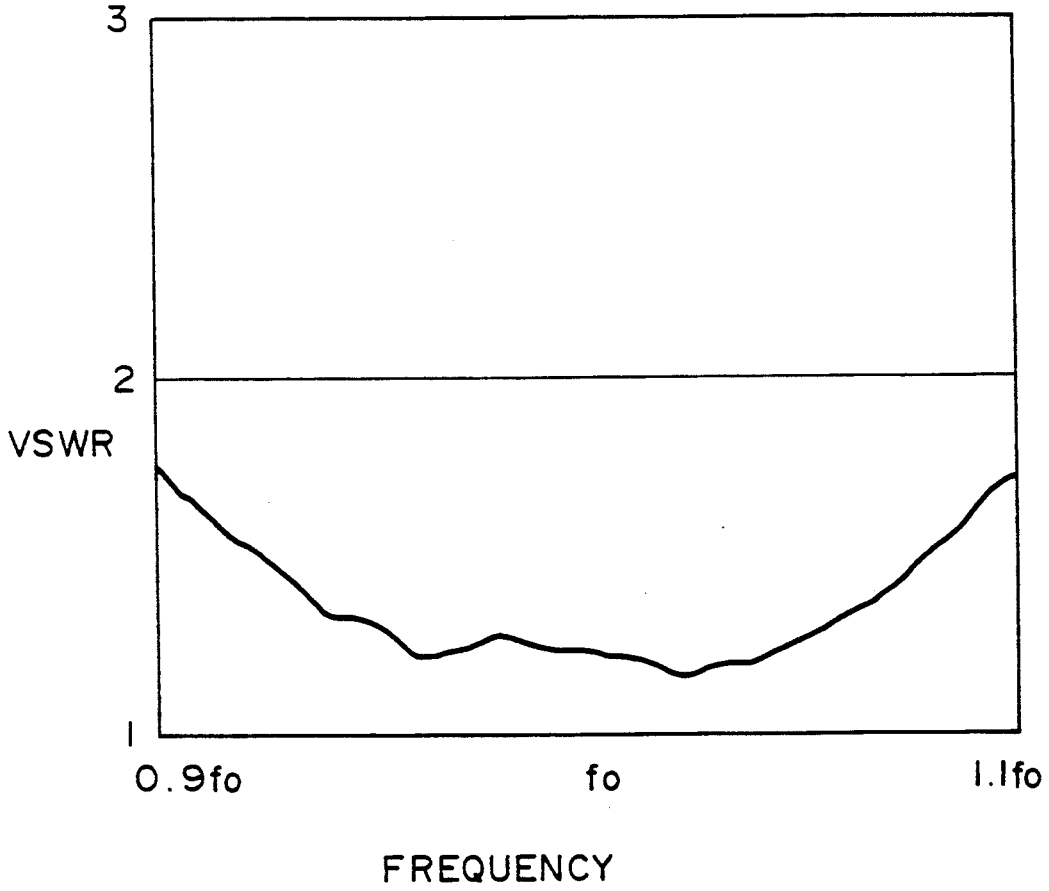
FIG. 5 is a characteristic curve of the VSWR frequency characteristic of the first embodiment.

It is preferable that the height H of the antenna, the width and the length $L_1$, $L_2$ of the table 28, the length $W_2$ of the upper edge 26b and the length $W_1$ of the lower edge 26a of the vertical feeding plate 26, the gap t between the lower edge 26a of the vertical feeding plate 26 and the ground plate 20 and the diameter $D_0$ of the post 30 respectively have the following relationships with the propagation wavelength $\lambda_0$:

$H=0.12\ \lambda_0$ $2H+L_1/2+L_2=0.525\ \lambda_0$ $(L_1=0.21\ \lambda_0,\ L_2=0.18\ \lambda_0)$ $W_1=W_2=0.105\ \lambda_0$ $t=0.003\ \lambda_0$ $D_0=0.165\ \lambda_0$ The voltage standing wave ratio VSWR of the antenna of the present invention produced under these conditions is shown in FIG. 5.

If it is assumed that the band width in which the antenna can be utilized is in the range in which the VSWR is not more than 2, the antenna of this embodiment has a relative band width of not less than 20%. The relative band width of 20% can be said to be a good characteristic, because it is much higher than about 8%, which is necessary for an antenna for mobile communication.

Figure 6:
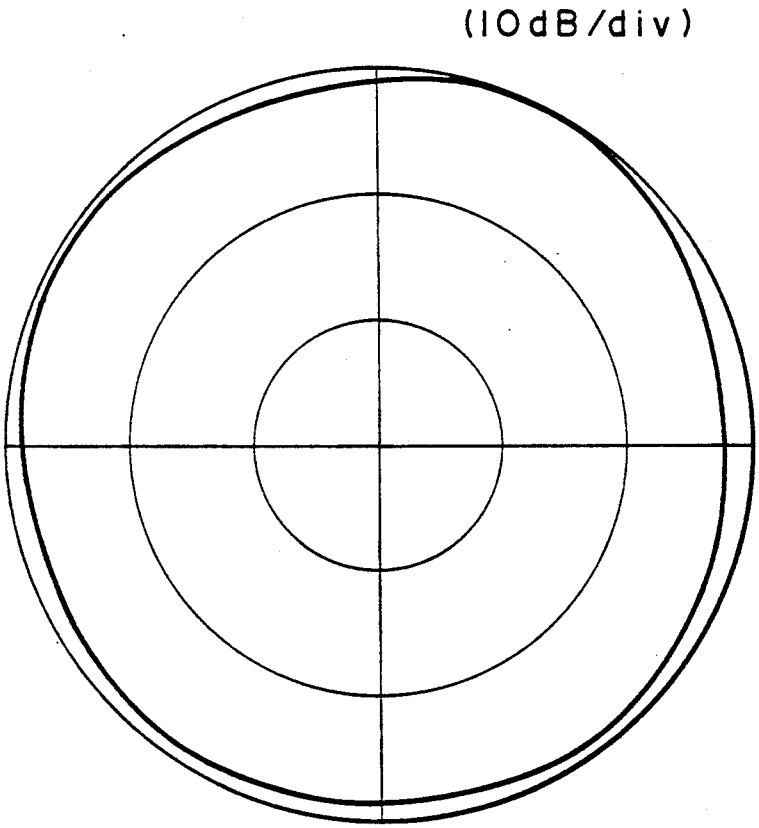
FIG. 6 is a characteristic curve of the radiation pattern of the first embodiment in a horizontal plane.

The radiation pattern of the antenna of this embodiment in a horizontal plane is shown in FIG. 6. It is observed that the antenna of this embodiment has an omni-directional pattern and is therefore suitable for a mobile communication apparatus.

Second Embodiment

Figure 7:
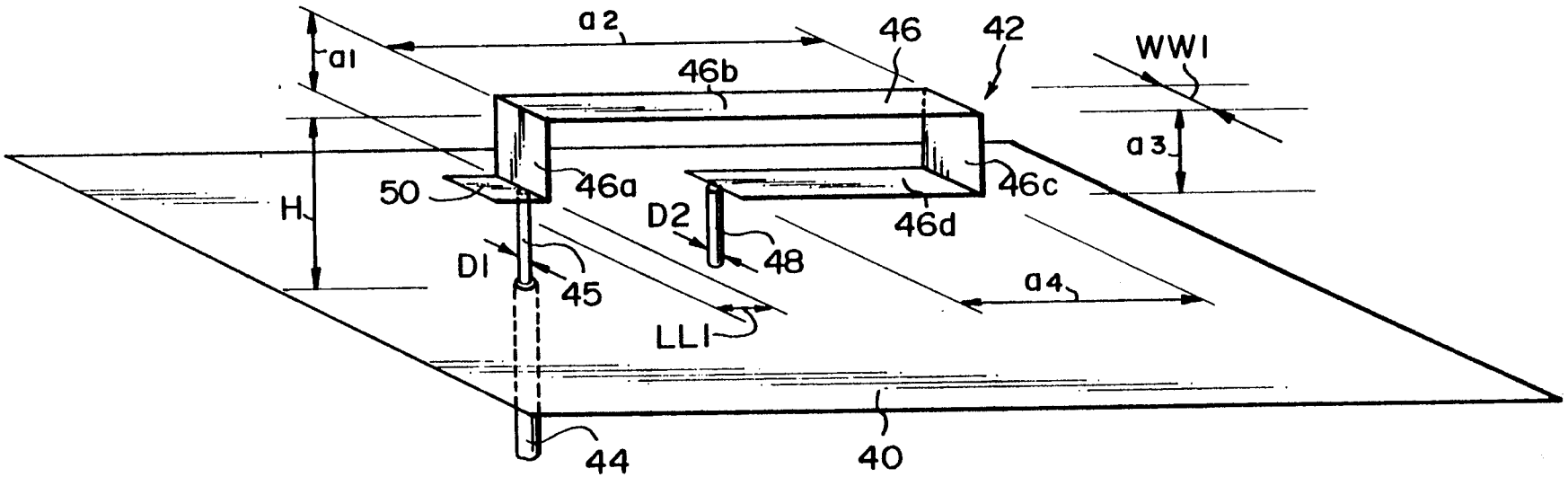
FIG. 7 is an external perspective view of the structure of a second embodiment of a mobile antenna according to the present invention.

FIG. 7 is an external perspective view of a second embodiment of the present invention.

In the antenna of the second embodiment, a radiating element 42 is disposed on a ground plate 40. The inner conductor 44a of a coaxial feeder 44 is connected to the radiating element 42 and the outer conductor 44b thereof is connected to the ground plate 40.

The radiating element 42 is composed of a feed probe 45 connected to the inner conductor 44a of the coaxial feeder 44, a strip conductor 46, a wire conductor (post) 48 for connecting the end of the strip conductor 46 with the ground plate 40 and a plate conductor element 50 for impedance compensation. The strip conductor 46 includes a first vertical member 46a, a first parallel member 46b, a second vertical member 46c and a second parallel member 46d.

In this embodiment, both the feed probe 45 and the post 48 are made of wire conductors, but they may be made of plate conductors with a narrow width.

In this embodiment, the plate conductor element 50 for impedance compensation is horizontally connected to the lower end of the first vertical member 46a of the strip conductor 46. If the plate conductor element 50 for impedance compensation is attached to a position about 0.01 to 0.05 wavelength above the ground plate 40, impedance matching with the coaxial feeder 44 is enabled.

Especially, if not only is a capacitance added by the plate conductor 50 for impedance compensation but if also the post 48 is made of a wire conductor, it is possible to adjust the reactance component of the loop antenna. It is therefore easy to cancel the reactance component of the antenna, thereby facilitating the matching of the antenna.

The strip conductor 46 is composed of the four parts 46a, 46b, 46c and 46d. The lengths of the respective parts $a_1$, $a_2$, $a_3$ and $a_4$ must satisfy at least the following conditions:

$a_1 \geqq 0.4\ H$ $0.8a_2 \geqq a_4$ wherein H represents the distance between the first horizontal member 46b of the strip conductor 46 and the ground plate 40.

The dimension of each part of the antenna of this embodiment will now be explained on the assumption that the central frequency for transmission and reception is $f_0$ (wavelength: $\lambda_0$).

Figure 8:
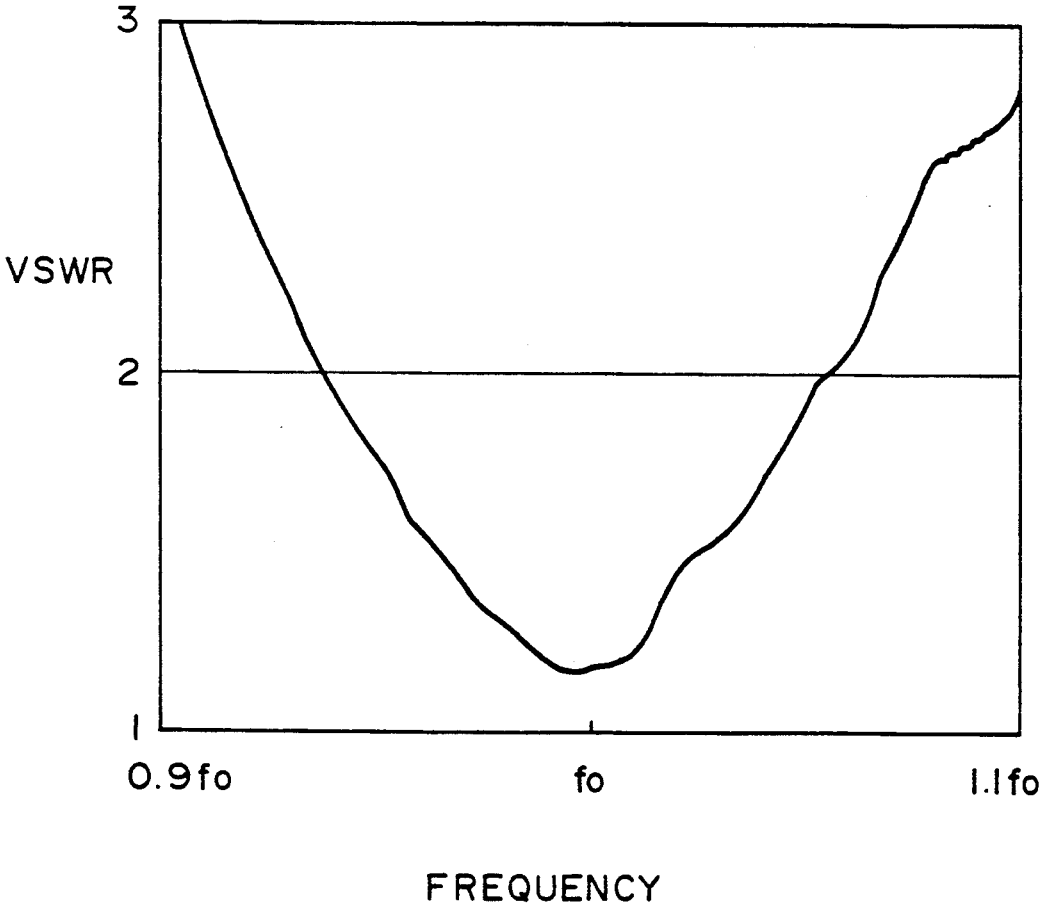
FIG. 8 is a characteristic curve of the VSWR frequency characteristic of the second embodiment shown in FIG. 7.

It is preferable that the width $WW_1$ of the strip conductor 46, th height H of the antenna, and the lengths $a_1$, $a_2$, $a_3$ and $a_4$ of the respective members of the strip conductor 46 are set to have the following relationships with the propagation wavelength $\lambda_0$:

$W=0.2\ \lambda_0,\ H=0.09\ \lambda_0$ $a_1=0.06\ \lambda_0,\ a_2=0.24\ \lambda_0,\ a_3=0.05\ \lambda_0,\ a_4=0.16\ \lambda_0$ The voltage standing wave ratio VSWR of the antenna of the present invention produced under these conditions is shown in FIG. 8. If it is assumed that the band width in which the antenna can be utilized is in the range in which the VSWR is not more than 2, the antenna of this embodiment has a relative band width of not less than 10%. It is therefore observed from FIG. 8 that the antenna of this embodiment has a sufficiently good characteristic as an antenna for mobile communication.

Figure 9:
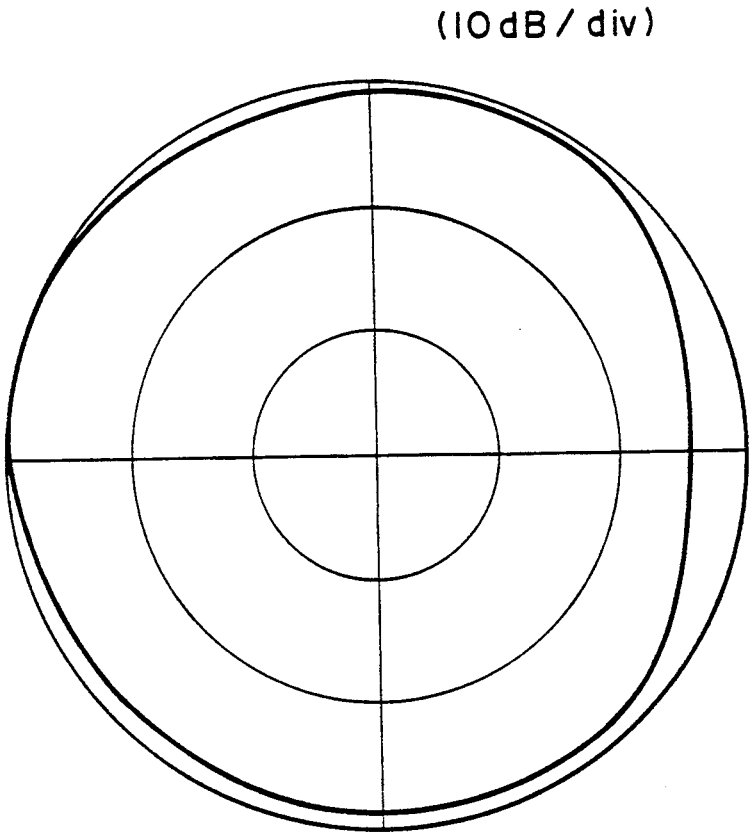
FIG. 9 is a characteristic curve of the pattern of the second embodiment in a horizontal plane.

The radiation pattern of the antenna of this embodiment in a horizontal plane is shown in FIG. 9. It is observed from FIG. 9 that although the pattern is slightly warped in comparison with the radiation pattern of the antenna of the first embodiment, it has a sufficient characteristic as an antenna for a mobile communication apparatus.

Third Embodiment

Figure 10:
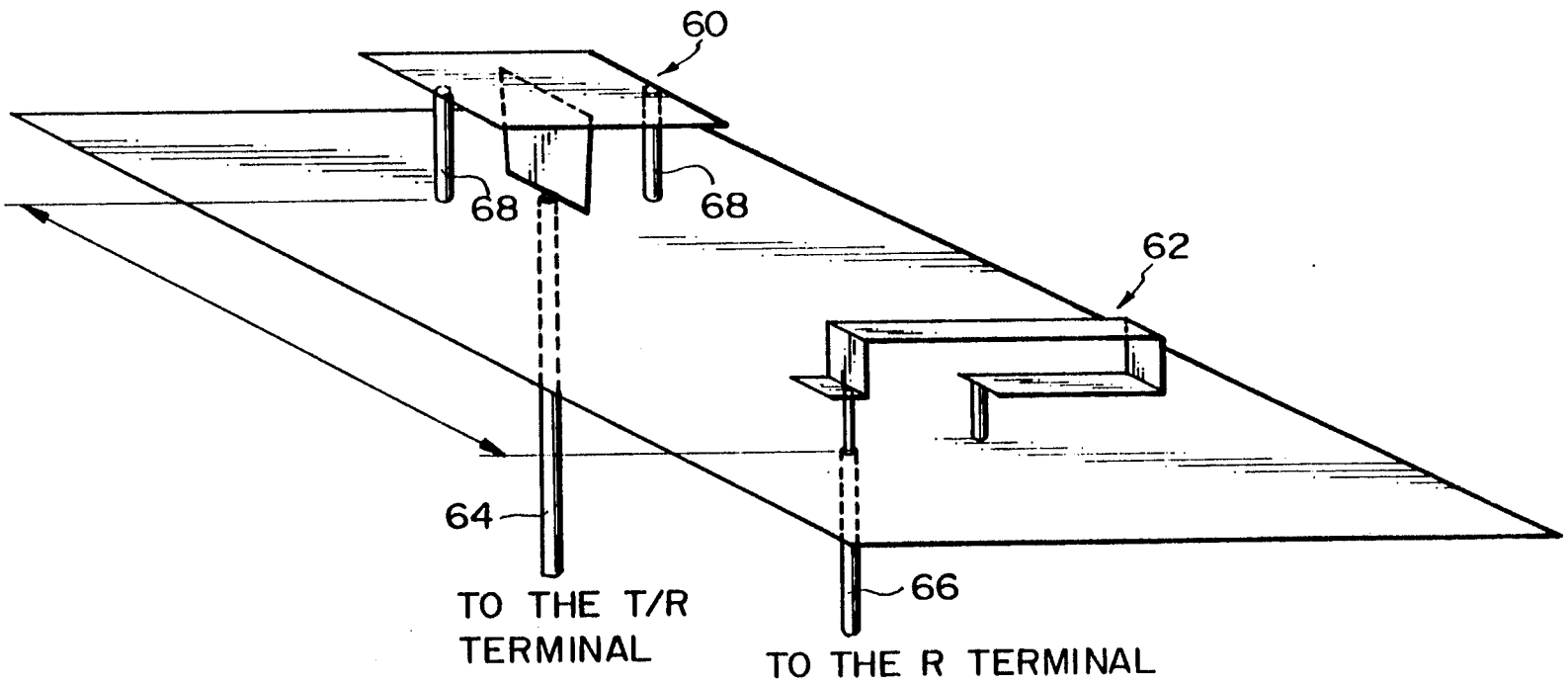
FIG. 10 is an external perspective view of the structure of a third embodiment of a mobile antenna according to the present invention.
Figure 11:
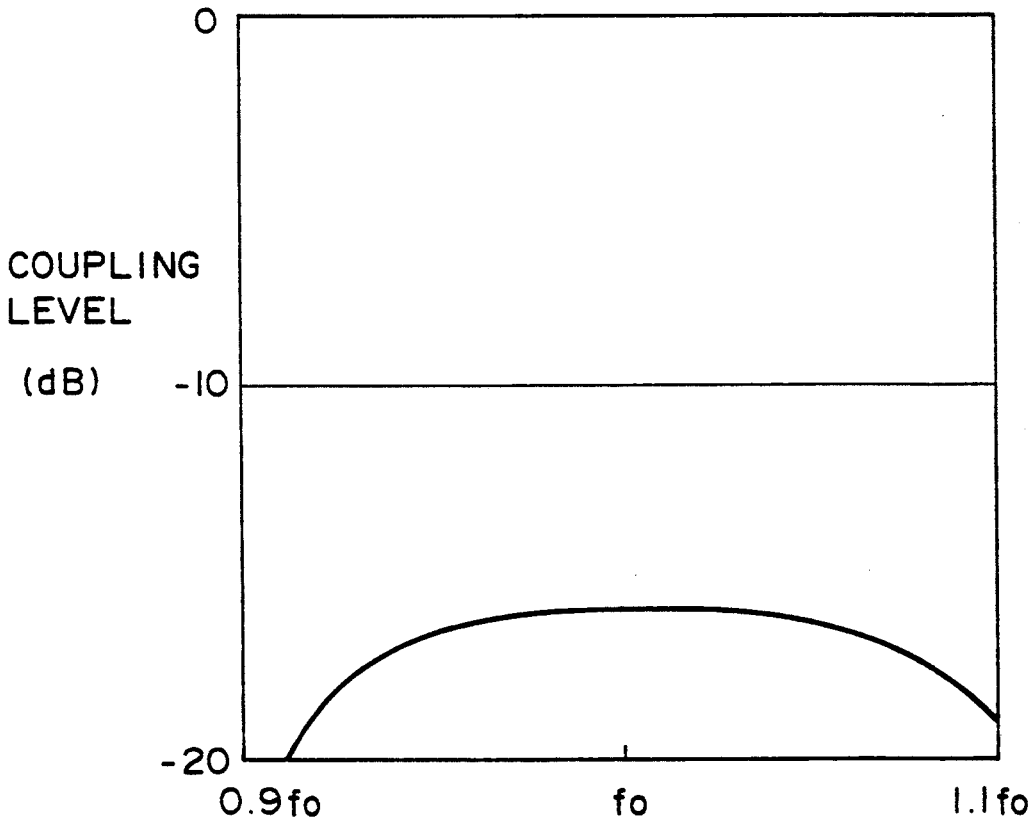
FIG. 11 is a characteristic curve of the coupling level of the elements in the third embodiment.
Figure 12:
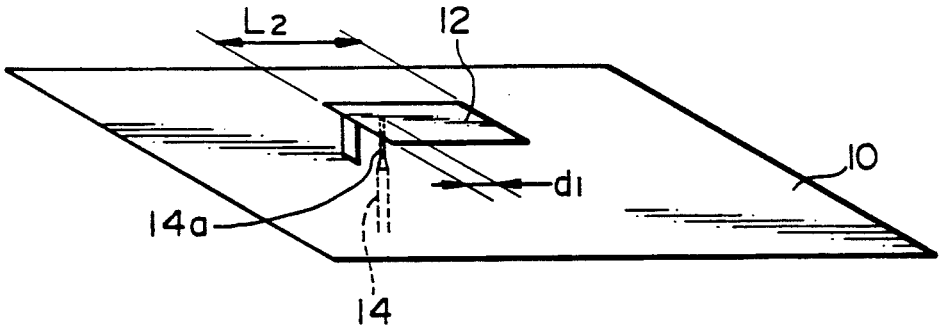
FIG. 12 PRIOR ART
FIG. 12 is an external perspective view of the structure of an inverted F antenna.
Figure 13:
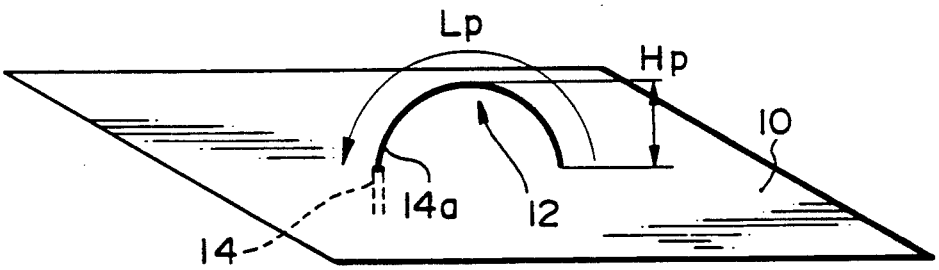
FIG. 13 PRIOR ART
FIG. 13 is an external perspective view of the structure of a loop antenna.
Figure 14:
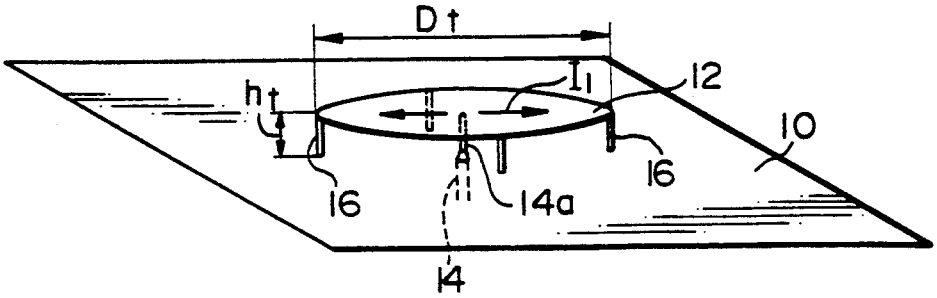
FIG. 14 PRIOR ART
FIG. 14 is an external perspective view of the structure of a table antenna.
Figure 15:
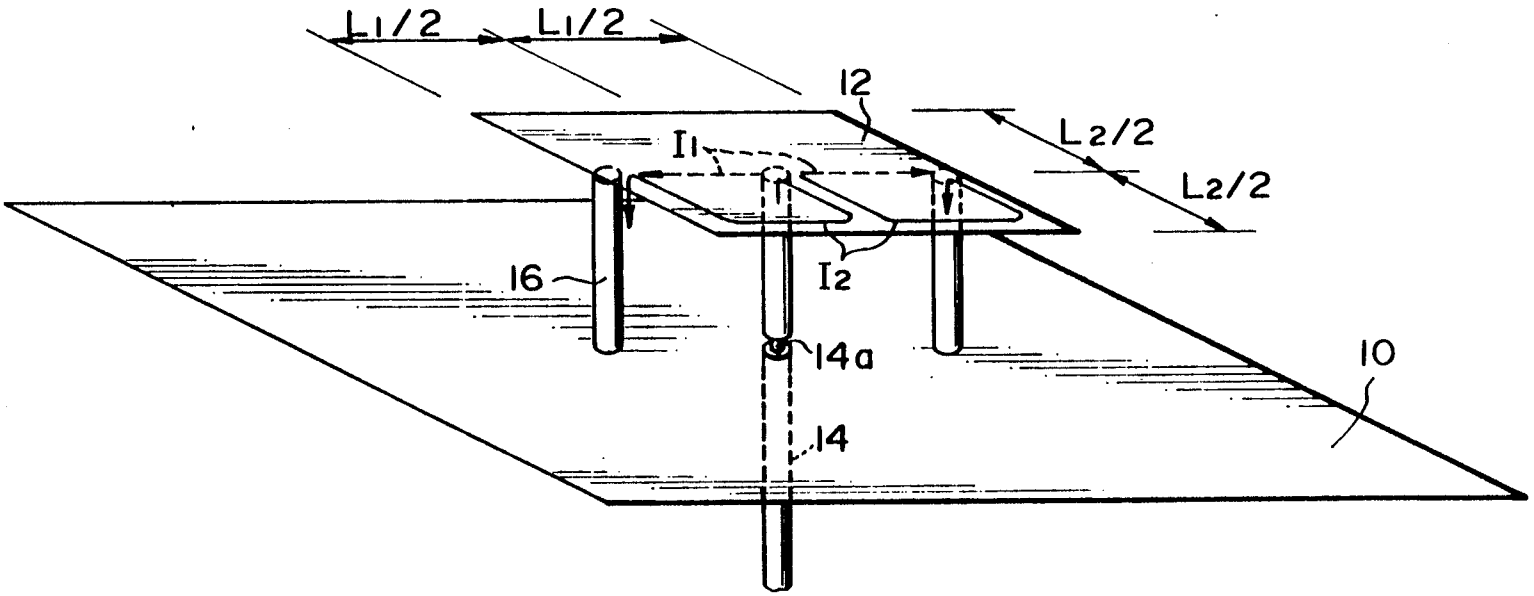
FIG. 15 is an external perspective view of the structure of a rectangular table antenna having two posts.

FIG. 10 is an external perspective view of a third embodiment of the present invention.

The antenna of this embodiment is a composite antenna obtained by arranging a radiating element 60 of the first embodiment and a radiating element 62 of the second embodiment.

In this embodiment, the radiating element 60 of the first embodiment, which has a wide band width and a directivity in a horizontal plane closer to an omni-directional antenna, is connected to a coaxial feeder 64 which is connected to a transmitter and a receiver, and is used as an antenna both for transmission and for reception, while the radiating element 62 of the second embodiment is connected to a coaxial feeder 66 which is connected only to the receiver means, and is used as an antenna exclusively for reception.

In this embodiment, the first and the second radiating elements 60, 62 are arranged adjacently to each other with a space of about not less than 0.4 $\lambda_0$ therebetween. By maintaining such a space between the first and the second radiating elements 60, 62, a sufficient diversity effect is obtained.

In this type of a composite antenna, it is necessary to reduce the mutual coupling as much as possible.

The second radiating element 60 is disposed at a position which is approximately equally distant from two wire grounding conductors (posts) 68 of the first radiating element 62. In other words, the plane in which the two posts 68 exist is parallel to the longitudinal direction of the second radiating element 62.

This arrangement prevents the magnetic field caused by the current which flows to the first radiating element 60 from passing through the loop of the second radiating element 62 (the interior of the loop radiating element 62), thereby lowering the coupling level of the first radiating element 60 and the second radiating element.

FIG. 9 shows the magnitude of coupling in this embodiment in which the distance between the feeding points of the two radiating elements 60, 62 is set at 0.375 wavelength. From FIG. 9, it is observed that a good value such as not more than −16 dB is obtained as the coupling level.

Other Structures

The antenna of the present invention is generally preferably mounted on the rear tray in the vehicle. In this case, the entire part of the antenna is preferably covered with a dielectric case such as a plastic case.

Since the radiating element of the antenna of the present invention is fixed to the ground plate by the posts, feed probe, etc., reinforcing is not particularly necessary, but it may be reinforced by a plastic material or the like, if necessary.

It is also possible to adjust the resonance frequency by inserting a dielectric having a predetermined dielectric constant between the radiating element and the ground plate.

In addition, it is possible to use the vehicle itself as the ground plate.

It is also possible to use two radiating elements in the first embodiment or two radiating elements in the second embodiment for effecting diversity reception.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A mobile antenna comprising a ground plate and a radiating element placed above the ground plate, wherein said radiating element comprises:

a vertical feeding plate disposed above said ground plate in such a manner that the surface thereof is vertical to the plane of said ground plate with a narrow space therebetween and a signal is fed to a central part of a lower edge thereof;

a plate, parallel to said ground plate, connected to an upper edge of said vertical feeding plate, said vertical feeding plate being connected to a central part of said parallel plate in such a manner as to divide said parallel plate in two parts; and a pair of conductors with one end of each connected to a central part of each end of said parallel plate which is parallel to said vertical feeding plate and an other end thereof connected to said ground plate, said pair of conductors being parallel to said vertical feeding plate.

2. A mobile antenna according to claim 1, wherein the length represented by the following formula is approximately ½ of the wavelength which corresponds to the central frequency of the radio wave transmitted and received:

$$2H+L_1/2+L_2$$

wherein H represents a distance between said ground plate and said parallel plate, $L_1$ represents the length of a side of said parallel plate which is orthogonal to the line on which said parallel plate is connected to said vertical feeding plate, and $L_2$ represents the length of a side of said parallel plate which is parallel to the line on which said parallel plate is connected to said vertical feeding plate.

3. A mobile antenna according to claim 2, wherein the length of the upper edge of said vertical feeding plate is equal to the length of the lower edge thereof.

4. A mobile antenna according to claim 2, wherein the length of the upper edge of said vertical feeding plate is larger than the length of the lower edge thereof.

5. A mobile antenna comprising a ground plate and a radiating element placed above the ground plate, wherein said radiating element comprises:

a first vertical member disposed above said ground plate in such a manner that the surface thereof is vertical to the plane of said ground plate with a narrow space therebetween and a signal is fed to a central part of a lower edge thereof;

a first parallel member connected to an upper end of said first vertical member and extending in parallel to said ground plate;

a second vertical member connected to an other end of said first parallel member vertically to said ground plate;

a second parallel member which is connected to an other end of said second vertical member and disposed at a position between said first parallel member and said ground plate in parallel thereto and which is shorter in length than said first parallel member;

a conductor for connecting an other end of said second parallel member and said ground plate; and a plate conductor element for impedance compensation which is connected to the lower edge of said first vertical member.

6. A mobile antenna according to claim 5, wherein both of said first vertical member and said second parallel member are plate conductors.

7. A mobile antenna according to claim 5, wherein said plate conductor element for impedance compensation is disposed in parallel to said ground plate.

8. A mobile antenna according to claim 5, wherein the following relationships are satisfied:

$$a_1 \geqq 0.4\ H$$

$$0.8\ a_2 \geqq a_4$$

wherein $a_1$ represents the length of said first vertical member,

H the distance between said first parallel portion and said ground plate, $a_2$ the length of said first parallel portion, and $a_4$ the length of said second parallel portion.

9. A mobile antenna according to claim 9, wherein said first vertical member, said first parallel member, said second vertical member, said second parallel member and said plate conductor element have the same width.

10. A mobile antenna comprising a ground plate and a plurality of radiating elements placed above said ground plate, wherein said plurality of radiating elements comprises:

a first radiating element including:

a vertical feeding plate disposed above said ground plate in such a manner that a lower edge thereof is located above said ground plate with a narrow space therebetween and a signal is fed to a central part of the lower edge thereof;

a parallel plate connected to an upper edge of said vertical feeding plate; and a pair of conductors with one end of each connected to a central part of each of said parallel plate which is parallel to said vertical feeding plate and an other end thereof connected to said ground plate;

a second radiating element including:

a first vertical member disposed above said ground plate in such a manner that one edge is placed above said ground plate with a narrow space therebetween and a signal is fed to a central part of a lower edge thereof;

a first parallel member connected to an upper end of said first vertical member and extending in parallel to said ground plate;

a second vertical member connected to an other end of said first parallel member vertically to said ground plate;

a second parallel member which is connected to an other end of said second vertical member and disposed at a position between said first parallel member and said ground plate in parallel thereto and which is shorter in length than said first parallel member;

a conductor for connecting an other end of said second parallel member and said ground plate; and a plate conductor element connected to the lower edge of said first vertical member;

said first and second radiating elements being arranged with a predetermined space therebetween such that the plane in which said pair of vertical conductors of said first radiating element exist is substantially parallel to the plane in which said first and second parallel members and said first and second vertical members of said second radiating element exist.

11. A mobile antenna according to claim 10, wherein said first radiating element is used both for transmission and for reception while said second radiating element is used exclusively for reception.

12. A mobile antenna according to claim 10, wherein the length represented by the following formula in said first radiating element is approximately ½ of the wavelength which corresponds to the central frequency of the radio wave transmitted and received:

$$2H + L_1/2 + L_2$$

wherein

H represents a distance between said ground plate and said parallel plate, $L_1$ represents the length of a side of said parallel plate which is orthogonal to the line on which said parallel plate is connected to said vertical feeding plate, and $L_2$ represents the length of a side of said parallel plate which is parallel to the line on which said parallel plate is connected to said vertical feeding plate; and said second radiating element satisfies the following relationships:

$$a_1 \geqq 0.4\ H$$

$$0.8\ a_2 \geqq a_4$$

wherein $a_1$ represents the length of said first vertical member,

H the distance between said first parallel portion and said ground plate, $a_2$ the length of said first parallel portion, and $a_4$ the length of said second parallel portion.

13. A mobile antenna according to claim 12, wherein said vertical feeding plate is connected to the central part of said parallel plate in such a manner as to divide said parallel plate into two parts;

the length of the upper edge of said vertical feeding plate is larger than the length of the lower edge thereof;

both of said first vertical member and said second parallel member are plate conductors; and said first vertical member, said first parallel member, said second vertical member, said second parallel member and said plate conductor element have the same width.

14. An antenna comprising:

a ground plate;

a feeding plate disposed above said ground plate through a narrow space therebetween, said feeding plate being perpendicular to the plane of said ground plate;

power supply means connected to a central part of a first end of said feeding plate through said ground plate to supply a signal to said feeding plate;

a parallel plate connected at its central part to a second end of said feeding plate, to thereby divide said parallel plate into first and second areas;

a first conductor connecting a central part of an end of said first area of said parallel plate to said ground plate, said first conductor being parallel to said feeding plate; and a second conductor connecting a central part of an end of said second area of said parallel plate to said ground plate, said second conductor being parallel to said feeding plate.

15. A antenna according to claim 14, wherein said parallel plate is in the shape of rectangle having a first side of length $L_1$ perpendicular to said feeding plate and a second side of length $L_2$ parallel to said feeding plate.

16. The antenna according to claim 15, wherein the length represented by the following formula is approximately ½ of the wavelength which corresponds to a central frequency of the radio wave transmitted and received by the antenna:

$$2H + L_1/2 + L_2$$

wherein

H represents a distance between said ground plate and said parallel plate, $L_1$ represents the length of the first side of said parallel plate; and $L_2$ represents the length of the second side of said parallel plate.

17. The antenna according to claim 16, wherein the length of the first end of said feeding plate is equal to the length of the second end of said feeding plate.

18. The antenna according to claim 16, wherein the length of the first end of said vertical feeding plate is less than the length of the second end of said feeding plate.

* * * * *